United States Patent [19]

Bussert

[11] Patent Number: 4,909,299

[45] Date of Patent: Mar. 20, 1990

[54] VERTICALLY ADJUSTABLE WINDOW COVERING AND CLIP

[76] Inventor: Althea J. Bussert, 610 W. Peralta Cir., Mesa, Ariz. 85210

[21] Appl. No.: 231,870

[22] Filed: Aug. 12, 1988

Related U.S. Application Data

[63] Continuation-in-part of Ser. No. 37,686, Apr. 13, 1987, Pat. No. 4,836,265.

[51] Int. Cl.[4] ..... A47H 23/00

[52] U.S. Cl. ..... 160/354; 160/368.1

[58] Field of Search ..... 160/368.1, 354, 135, 160/351, 330, 348, 349.1; 248/74.2

[56] References Cited

U.S. PATENT DOCUMENTS

| | | | |
|---|---|---|---|
| 1,429,776 | 9/1922 | Robinson | 248/74.2 |
| 2,246,663 | 6/1941 | Bradshaw . | |
| 2,299,173 | 10/1942 | Pidgeon | 160/349.1 X |
| 2,514,316 | 7/1950 | Dobrin . | |
| 2,943,676 | 7/1960 | Grenci . | |
| 3,283,804 | 11/1966 | Yancy . | |
| 3,480,069 | 11/1969 | Handwerker . | |
| 3,913,655 | 10/1975 | Ogino | 160/84.1 |
| 3,996,083 | 12/1976 | Morgan et al. | 156/92 |
| 4,044,813 | 8/1977 | Emmons . | |
| 4,068,428 | 1/1978 | Peterson . | |
| 4,131,150 | 12/1978 | Papadakis . | |
| 4,221,256 | 9/1980 | Karaki | 160/368.1 |
| 4,249,589 | 2/1981 | Loeb | 160/368.1 |
| 4,560,245 | 12/1985 | Sarver | 296/95 C |
| 4,836,265 | 6/1989 | Bussert | 160/354 |

*Primary Examiner*—Blair M. Johnson

*Attorney, Agent, or Firm*—Cahill, Sutton & Thomas

[57] ABSTRACT

A bendable sheet of material includes a column of apertures disposed along each opposed vertical side and support structure for suspending the sheet from its upper edge. A pair of clips, secured to the lower edge of the sheet, penetrably cooperate with the columns of apertures to selectively retain the sheet foldable upon itself to a predetermined degree. The pair of clips are adapted to penetrably engage a further fold of the folded part of the sheet to selectively further reduce the area defined by the suspended sheet.

17 Claims, 1 Drawing Sheet

VERTICALLY ADJUSTABLE WINDOW COVERING AND CLIP

CROSS REFERENCE TO RELATED APPLICATIONS

This is a continuation in part application of an application entitled "TEMPORARY WINDOW SHADES", filed on Apr. 13, 1987, assigned Ser. No. 037,686 and describing an invention by the present inventor.

BACKGROUND OF THE INVENTION

1. Field of the Invention

This invention relates to window coverings and, more particularly, to temporary selectively raisable window shades and clips therefor.

2. Description of the Prior Art

New home owners and renters very often find that they must wait a long time before they are able to install new shades or draperies across their windows. This is especially true in the case of custom-made draperies, since the process of measuring, ordering and stitching the drapery materials is quite lengthy. Even ready made draperies are usually not purchased immediately as they are somewhat expensive and as the buyer usually shops around before finally selecting permanent drapes. In order to protect one's privacy, as well as to block out bright sunlight, new occupants frequently resort to temporary measures, such as hanging sheets or pasting newspapers or the like over their windows. Such measures are usually unsatisfactory, as the sheets or newspapers are a nuisance to put up and tend to detract from the appearance of the house or apartment. In addition, there is no convenient way to raise and lower these types of window coverings. Accordingly, the occupant cannot readily vary the amount of light shining through the windows or selectively have a view of the outdoors.

The closest known attempt to solve the above problems is described in U.S. Pat. No. 3,913,655. Herein, a temporary paper curtain is disclosed which has a first strip of stiffener material attached to its top edge and a second strip of stiffener material attached to its bottom edge. The first strip serves as an attachment strip for attaching the curtain to a wall and the second strip serves as a stiffening and weighting device to ensure that the curtain hangs correctly. In one embodiment of the invention, bores are provided through each of the stiffener strips and a plurality of vertically spaced apart holes are provided along one side of the paper sheet. A pull cord passing through the bores and the aligned holes allow the curtain to be raised and lowered. This means for raising and lowering the curtain is not entirely satisfactory, since the process of boring holes in the stiffener strips and threading the pull cord through the sheet adds to the cost and complexity of the product.

SUMMARY OF THE INVENTION

A temporary window covering constructed in accordance with the present invention includes a sheet of rugged, relatively inexpensive material, such as nylon, polyester, or reinforced paper to serve the function of covering a selected part of a window. The upper and lower edges of the covering are preferably folded to form hems and a stiffening rod is inserted into the lower hem to provide weight and urge the covering to hang flat. The hem along the top edge may be provided with double-sided adhesive tape, hook and loop type fasteners, or holes for receiving nails, hooks or the like, to secure the covering to the upper window frame or a wall above the window. A pair of clips extend from opposed ends of the bottom stiffening rod. Each clip includes a flange segment extending at an angle from opposed sides of a support member. A plurality of slots are formed in longitudinally spaced increments proximate each of the vertical edges of the covering for receiving a flange segment of one of the clips. To raise the covering to a desired height, the homeowner merely folds the covering upwardly and positionally fixes the bottom edge of the covering in the folded position by passing one of the flange segments of each of the two clips through a selected transversely aligned pair of slots in the covering. The folded part of the covering may be folded upwardly again and retained in place by penetrable engagement of a further transversely aligned pair of slots with the other flange segments of the clips. By easily disengaging the flange segments, the covering will unfold to its depending state and cover the underlying window.

A primary object of the present invention is to provide a foldably adjustable temporary window covering for covering a selected part of a window.

Another object of the present invention is to provide an inexpensive window covering for covering a selectable portion of a window.

Yet another object of the present invention is to provide a clip for retaining at any of a plurality of locations a folded part of a window covering.

Still another object of the present invention is to provide a clip for selectively retaining multiple folds of a depending window covering.

A further object of the present invention is to provide an inexpensive clip attached to the lower edge of a window covering for positionally retaining one or more folds of the window covering to partially uncover an adjacent window.

A yet further object of the present invention is to provide a method for inexpensively covering a window to a selected extent.

A yet further object of the present invention is to provide a removably attached clip for retaining folded portions of a window covering to uncover a selected extent of an adjacent window.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
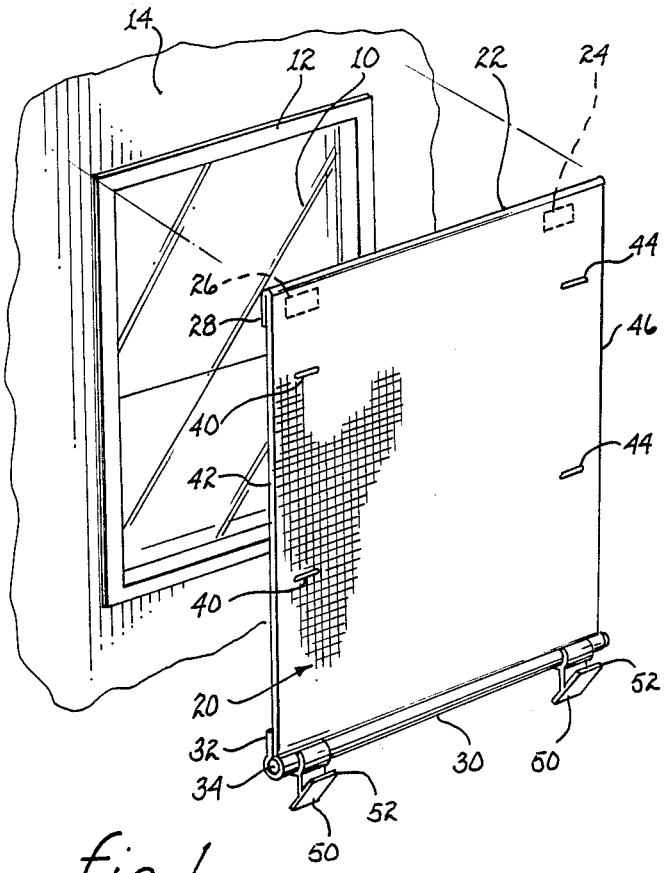
FIG. 1 is an isometric view of a depending window covering locatable adjacent a window.

Referring to FIG. 1, there is shown, in representative form, a window 10 mounted within a frame 12 in wall 14. The window may be any type of window, such as a permanently closed window, a sliding glass window, a casement window, etc. Similarly, frame 12 may be made of any material, such as wood, metal, man-made plastic, etc. Wall 14 may be of conventional construction, stucco, etc.

Coverings for windows are used predominantly to limit the light passing through the window and for reasons of privacy. In conjunction therewith, the type or nature of the window covering is selected primarily for decorative purposes, barring some other overriding concern. At the time of initial occupancy of a dwelling, the windows are usually uncovered pending a decision by the occupant as to type, nature and design of the window coverings. Until permanent window coverings are obtained and installed, the need exists, for reasons stated above, to cover the windows. Preferably, any window covering used for temporary purposes should be capable of being selectively positionable for control of light transmitted through the window and to provide the capability for looking out through the window.

Window covering 20 may be opaque, translucent or may even be of a visually transparent but ultraviolet opaque material. Preferably, it is somewhat tear resistant and readily foldable. Whether window covering 20 is of man-made composite materials, natural fibers or a blend is unimportant for purposes of the invention. For artistic and decorative purposes, the window covering may be colored, patterned or textured.

Structurally, window covering 20 includes an upper edge 22 commensurate in configuration with the upper part of window 10, frame 12 or adjacent wall surface 14. The upper edge may be attached either to the window, to the frame or to the wall surface by two or more patches (24, 26) of double-sided adhesive tape. Other attachment means, such as nails, thumbtacks, hooks, etc. may also be used, if feasible and prudent. Upper edge 22 may include a hem 28, as illustrated, to provide additional rigidity. For long span installations or window coverings which may be exceedingly limp, stiffening means may be added to upper edge 22 to prevent droop of the upper edge.

The plan form of window covering 20 may be rectangular, as illustrated, commensurate with the size and configuration of window 10. Alternatively, it may be oversized in situations where minimized light transmissibility is of major concern or where decorative considerations so suggest.

Lower edge 30 of window covering 20 may be hemmed with hem 32, as illustrated to add stiffness or rigidity to the lower edge. A bar or rod 34 may be inserted within the hem to further stiffen the lower edge. The rod will also add weight, which weight will encourage the window covering to hang straight.

A plurality of vertically aligned penetrable means, such as slots 40, are disposed in proximity to side edge 42 of window covering 20. A plurality of similar slots 44 are vertically aligned along side edge 46. It is intended that slots 40 be transversely generally aligned with slots 44. For extended span window coverings, a further set of vertical slots may be formed intermediate slots 40 and 44. A pair of clips 50 are attached to and extend from lower edge 30. Each of these clips includes suspension means 52 for selective engagement with a respective one of a pair of transversely aligned slots 40, 44. Upon such engagement, lower edge 30 will be suspended from the engaged pair of slots and the lower part of window covering 20 will be folded upon itself. Such folding will uncover a lower part of adjacent window 10.

Figure 4:
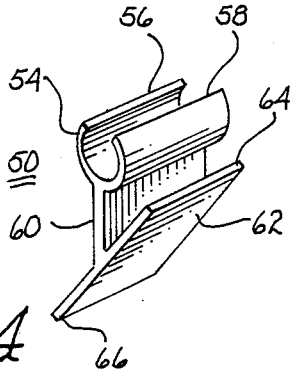
FIG. 4 is an isometric view of a clip usable with the window covering to retain it in place.
Figure 2:
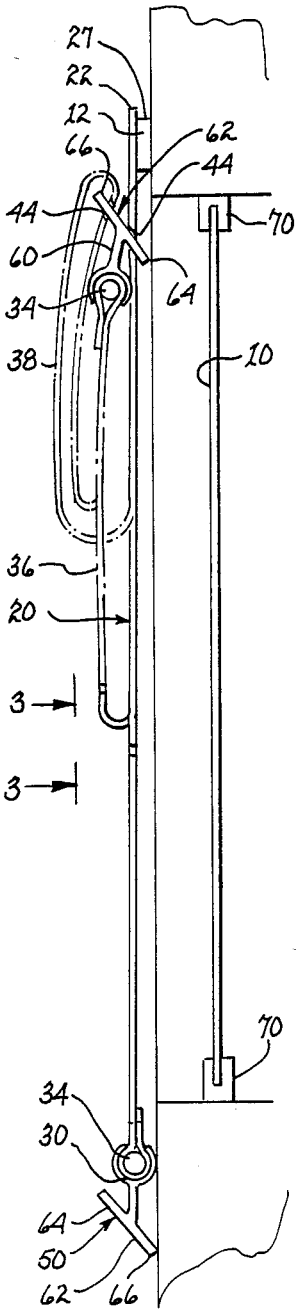
FIG. 2 is a cross sectional view of the window covering adjacent a window and shown in each of three selectable positions.

Referring particularly to FIG. 4, the structure of clip 50 will be described in detail. The clip includes retention means 54 for engaging lower edge 30. In the embodiment illustrated, the retention means is a segment of a split cylindrical sleeve having opposed longitudinal edges 56, 58. The diameter of the retention means or sleeve 54 is a function of rod 34 and the material of hem 32 extending thereabout, as illustrated in FIGS. 1 and 2. Preferably, the sleeve is of resilient material to permit the sleeve to grippingly engage the partially encircled rod. Suspension means 52 includes a support member 60 extending laterally from and in longitudinal alignment with sleeve 54. The support member supports an attached flange 62 in a non-perpendicular relationship therewith. The flange includes a first segment 64 set at an acute angle with respect to support member 60 and a second segment 66 set at an obtuse angle with regard to the support member. It may be noted that the first and second segments lie in a common plane and are an extension of one another.

Figure 3:
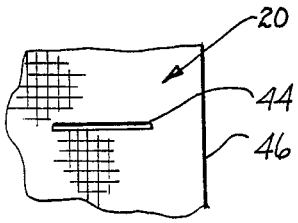
FIG. 3 is a partial view taken along lines 3—3, as shown in FIG. 2.

Referring to FIG. 3, there is illustrated a slot 44 disposed generally adjacent side edge 46 in the illustrated portion of window covering 20. The length of the slot is commensurate with that of the width of flange 62. Moreover, the width of the slot is sufficient to accommodate penetrable engagement by either the first or second segment of flange 62.

Referring to FIG. 2, the operation of the present invention will be described in detail. Window 10 is mounted within frame 12 by conventional means, representatively indicated by receiver 70. Patches 24, 26 of which patch 24 is illustrated, adhesively secure upper edge 22 of wall covering 20 adjacent the surface of frame 12. Accordingly, the window covering depends from the upper part of the frame surrounding window 10. Being of a length greater than the window, the window covering will cover the window. Rod 34, providing both weight and rigidity to bottom edge 30 of the window covering will tend to maintain the window covering planar with the window and generally flat. The additional weight provided by clips 50 may be of assistance in retaining the window covering in place.

To uncover a portion of window 10 for the purpose of letting in light or to see through the window, a lower part of the window covering may be folded upwardly upon itself, as represented by folded portion 36 illustrated in dashed lines in FIG. 2. The folded portion is retained in place by penetrably engaging first segment 64 of flange 62 with slot 44. A second clip 50 is in similar engagement with transversely aligned slot 40. Because of the angled relationship of first segment 64 with respect to support member 60 and the depending relationship of folded portion 36, the weight of the folded portion, including rod 34, will tend to urge penetration of first segment 64 through slot 44. With such urging, possible flapping of the window covering due to an airflow through an opened part of window 10 will generally not result in disengagement between folded portion 36. Moreover, accidental brushing against the folded over portion will tend not to result in disengagement of clips 50 and the engaged slots.

To obtain yet further exposure of window 10, folded over portion 36 may be folded upon itself, as depicted by further folded portion 38, shown in dashed lines in FIG. 2. In this configuration, a further slot 44 is engaged by second segment 66 of flange 62. Because of the angular orientation of the second segment, the weight of folded over portion 38 will tend to encourage and maintain penetrable engagement between the slot and the second segment. A second clip 50 associated with bottom edge of window covering 20 is similarly engaged with a transversely aligned slot 40.

To recover a portion of window 10, folded portion 38 may be slightly lifted by drawing it upwardly and away from respective clips 50 to bring about disengagement of slots 40, 44 with the corresponding second segments of the clips. Thereafter, folded portion 36 may be released to permit it to drop. Similarly, folded portion 38 is readily released by repositioning lower edge 30 upwardly and away from window 10 to disengage first segments 64 of clips 50 with corresponding slots 40, 44. The lower edge may then be allowed to drop whereafter it will assume the position depicted in FIG. 2 to cover window 10.

Because the cross section of clip 50 is uniform throughout the length of the clip, it is well adapted to conventional extrusion techniques. Accordingly, an extended length of clip 50 can be readily manufactured by suitable man-made plastic material at a very nominal cost. Thereafter, the length can be cut to any length segments suitable for the purposes described above. By forming clip 50 of material having a certain degree of resiliency and flexibility, any given diameter of retaining means 54 can accommodate a range of diametrically sized rods 34 and encircling window covering. It is to be noted that the retaining means can be otherwise configured to accommodate various means for attaching clip 50 to a lower edge 30 which may be flat, rectangular, circular, etc. Moreover, other fastening means may be employed to secure retaining means 54 to lower edge 30.

From the above description and the accompanying illustrations, it will be apparent that window covering 20 is relatively simple in structure and yet clip 50 is sophisticated in design and configuration to permit great ease in folding over and retaining one or more folds of the window covering. Accordingly, window covering 20 is sufficiently inexpensive to be used as a temporary discardable covering and yet it is capable of providing all of the advantages of more conventional window coverings with respect to light control, privacy, selected exposure of the window and decorative value.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An adjustable temporary and discardable window covering for providing selected exposure through a window, said covering comprising in combination:

(a) a sheet of material for limiting the exposure of a window;

(b) means for attaching said sheet in vertically depending relationship adjacent the window;

(c) at least one first penetrable means disposed in one vertical section of said sheet;

(d) at least one second penetrable means disposed in an other vertical section of said sheet; and (e) suspension means associated with the lower part of said sheet for selectively retainingly engaging said first and second penetrable means in said one and other vertical sections of said sheet to retain said sheet at least partially folded upwardly upon itself upon engagement of said suspension means with at least one of said first and second penetrable means, said suspension means comprising means for retaining a part of said sheet, means for penetrably engaging a selected one of said first and second penetrable means and further means for penetrably engaging another of said first and second penetrable means upon further folding of said sheet, said engaging means and said further engaging means extending in opposed directions.

2. The covering as set forth in claim 1 including a first pair of columns of said first penetrable means disposed in said one vertical section of said sheet and a second pair of columns of said second penetrable means disposed in said other vertical section of said sheet.

3. The covering as set forth in claim 2 wherein each of said first and second penetrable means comprises first and second slots, respectively, wherein said sheet includes vertical side edges and wherein said first pair of columns of said first slots are adjacent respective ones of said pair of vertical side edges and wherein said second pair of columns of said second slots are adjacent said pair of vertical side edges.

4. The covering as set forth in claim 1 wherein said sheet includes a bottom edge and wherein said suspension means is secured to said bottom edge.

5. The covering as set forth in claim 1 wherein said engaging means includes means for urging and maintaining penetrable engagement with the engaged one of said first penetrable means in response to the weight of the folded part of said sheet.

6. The covering as set forth in claim 1 wherein said engaging means and said further engaging means include means for maintaining penetrable engagement with said first penetrable means engaged by said engaging means and with said second penetrable means engaged by said further engaging means in response to the weight of the folded and further folded parts, respectively, of said sheet.

7. Apparatus for temporarily covering a window to a selected degree of exposure, said apparatus comprising in combination:

I. a window covering comprising:

(a) material foldable upon itself to expose the window commensurate with the width and number of folds;

(b) at least a column of slots extending upwardly from a lower edge of said covering;

(c) means for vertically depending supporting said covering across a window; and II. a clip comprising:

(a) retention means for retaining the lower edge of said covering;

(b) a flange for engaging one of said slots in said covering, said flange having a width commensurate with the width of said slots for penetrably engaging one of said slots upon folding of a lower part of said covering adjacent an upper part of said covering; and (c) means for supporting said flange upon said retention means; whereby, said clip retains said covering folded over to expose a part of the covered window by retaining the lower edge proximate a selected one of said slots.

8. The apparatus as set forth in claim 7 wherein said flange includes two segments extending in opposed directions from said supporting means, one of said segments being usable to engage a first one of said slots to establish a first fold of said covering and the other of said segments being usable to engage a second one of said slots of the first fold to establish a second fold of said covering.

9. The apparatus as set forth in claim 8 wherein said one segment extends at an acute angle from said supporting means and said other segment extends at an obtuse angle from said supporting means.

10. The apparatus as set forth in claim 8 including means for urging penetrable engagement of each of said one and other segments with the respective one of the said slots in the covering.

11. The apparatus as set forth in claim 7 wherein said covering includes a rod disposed along the lower edge and wherein said retention means includes means for engaging the rod.

12. The apparatus as set forth in claim 11 wherein said engaging means includes a split sleeve for partially encircling said rod.

13. The apparatus as set forth in claim 12 wherein said split sleeve is of resilient material to permit gripping of said rod by said split sleeve.

14. The apparatus as set forth in claim 12 wherein said supporting means comprises a planar section extending radially from said split sleeve to a terminal edge.

15. The apparatus as set forth in claim 14 wherein said flange is disposed at said terminal edge of said planar section.

16. The apparatus as set forth in claim 15 wherein said flange includes two segments extending in opposed directions from said terminal edge of said planar section.

17. The apparatus as set forth in claim 16 wherein one of said two segments extends at an acute angle from said planar section and the other of said two segments extends at a complementary obtuse angle from said planar section.

* * * * *